US005390378A

United States Patent [19]

Janisch

[11] Patent Number: 5,390,378

[45] Date of Patent: Feb. 21, 1995

[54] BATHTUB SEAT ARRANGEMENT FOR HANDICAPPED PERSONS

[75] Inventor: Klaus Janisch, Isny, Germany

[73] Assignee: Schmidt & Lenhardt GmbH & Co. oHG, Germany

[21] Appl. No.: 205,942

[22] Filed: Mar. 2, 1994

[30] Foreign Application Priority Data

Mar. 16, 1993 [EP] European Pat. Off. ..... 93104198

[51] Int. Cl.[6] ..... A47K 3/12

[52] U.S. Cl. ..... 4/578.1; 5/81.1

[58] Field of Search ..... 4/559, 578.1, 579, 604, 4/611; 5/81.1

[56] References Cited

U.S. PATENT DOCUMENTS 2,237,076 4/1941 Kenney et al. ..... 4/578.1
4,253,203 3/1981 Thomas ..... 4/604 X
5,068,930 12/1991 Ruggiero ..... 4/579

FOREIGN PATENT DOCUMENTS 1586660 3/1981 United Kingdom ..... 4/578.1

*Primary Examiner*—Charles E. Phillips
*Attorney, Agent, or Firm*—Notaro & Michalos

[57] ABSTRACT

A rotary plate (14) is longitudinally displaceable on a base plate (12) of extended length. The rotary plate (14) features a central pin (36) which can be moved from a locked position into an unlocked position and back. In its locked position, the pin (36) engages with a hole (30) in the base plate (12) and prevents a displacement of the rotary plate (14).

10 Claims, 4 Drawing Sheets

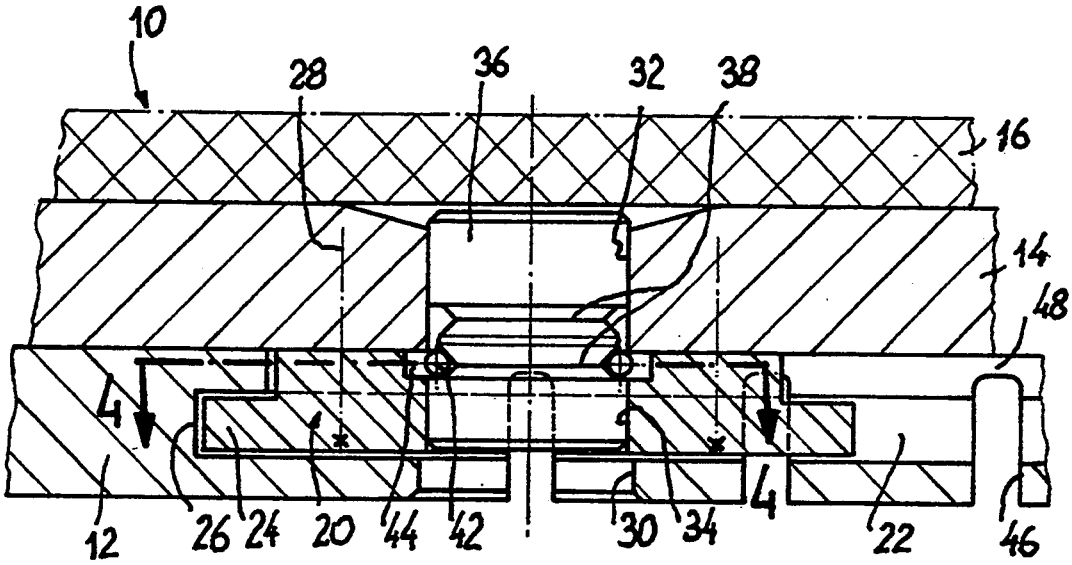
FIG.3
FIG.6
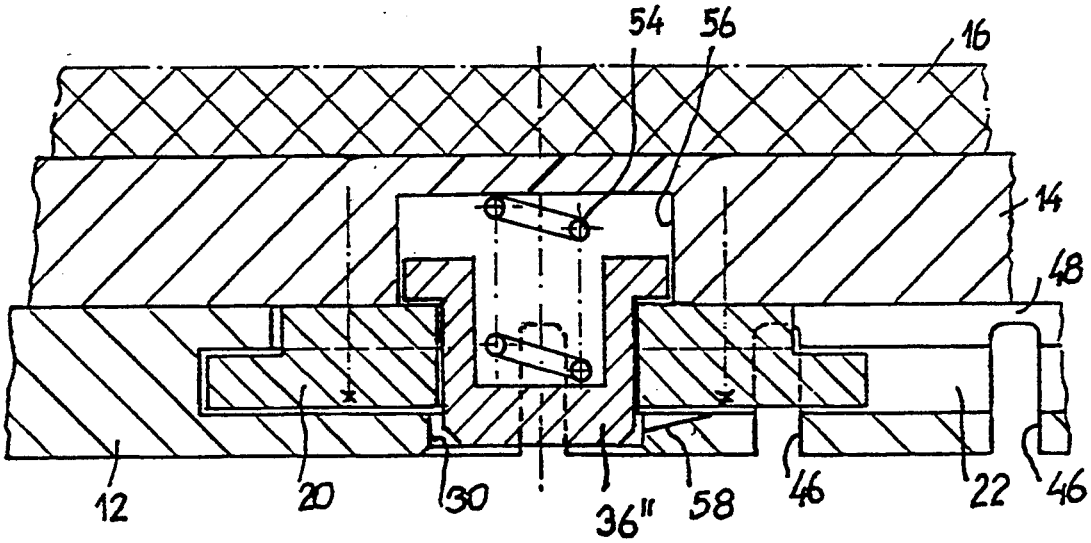

BATHTUB SEAT ARRANGEMENT FOR HANDICAPPED PERSONS

PRIOR ART

The invention concerns a seat arrangement for handicapped persons with a track on which a rotary plate is movable between two end positions and rotatably journalled in at least one of its end positions, with a locking pin which secures the rotary plate against displacement in at least one of its slide end positions.

Such a seat is known from U.S. Pat. No. 5,068,930. The track consists of a platform featuring bars, said platform being supported in turn by a frame. The seat is an integral element of a chair which can be placed, for instance, in a bathtub. Owing to its considerable height, this seat is not suitable for use with a liftable and lowerable bath lifter or in a handicapped person's bed.

SUMMARY OF THE INVENTION

The object of the invention is to develop a seat of the kind mentioned at the outset whereby the seat has as shallow a design as possible, is also suitable as a supporting platform for rotating and displacing the handicapped person, and consists of a small number of plastic parts, can be manufactured at little expense and permits operation by the handicapped person him/herself.

According to the invention, the track is designed as a thin base plate of extended length whose length measured along its axis of displacement is at least twice as great as the diameter of the rotary plate and which features a central longitudinal channel in which a circularly contoured slide plate provided on the underside of the rotary plate is guided such that it can be rotated and longitudinally displaced; the rotary plate and the slide plate each feature a downwardly open aperture which is coaxially aligned with the axis of rotation; a base hole with a longitudinal distance from the end of the longitudinal channel equal to the radius of the circular slide plate is provided in the base wall of the longitudinal channel; and the locking pin is capable of being axially displaced in the holes of the rotary plate and of the slide plate and engages with the base hole of the base plate at one of the slide end positions.

The invention also only temporarily facilitates the displacement function, namely for the manoeuvring of a handicapped person, whilst the rotary plate can be locked again in its slide end position in such a way that said rotary plate can only be rotated. Such a function is of benefit in connection, for instance, with bath lifters.

In accordance with one embodiment of the invention, the rotary plate can also be temporarily locked to prevent rotation, which is also beneficial in connection with bath lifters to afford the handicapped person a secure sitting position.

Thanks to the exceptionally shallow design of only approx. 10 mm in height, the seat can be used in a bed for displacing and turning patients. When used in conjunction with bath lifters as well, the invention offers major advantages since the maximum immersion depth of the handicapped person sitting on the height-adjustable plate of the lifter is barely reduced. Thanks to transverse grooves in the base plate, the end of the plate can rest against the wall of the bathtub while the seat plate of the lifter is lowered. The group of transverse grooves act as a planar hinge and the rigid plastic exerts an elastic restoring force at the hinge.

BRIEF DESCRIPTION OF THE DRAWING

The invention is described in greater detail with reference to the drawing which presents several embodiments.

It shows:

FIG. 3 an enlarged sectional view of the central locking means of the rotary table, FIG. 4 a horizontal sectional view along the line 4—4 of FIG. 3, FIG. 5 a sectional view similar to FIG. 3, but with an alternative embodiment, FIG. 6*a* sectional view through another embodiment of the invention.

Figure 1:
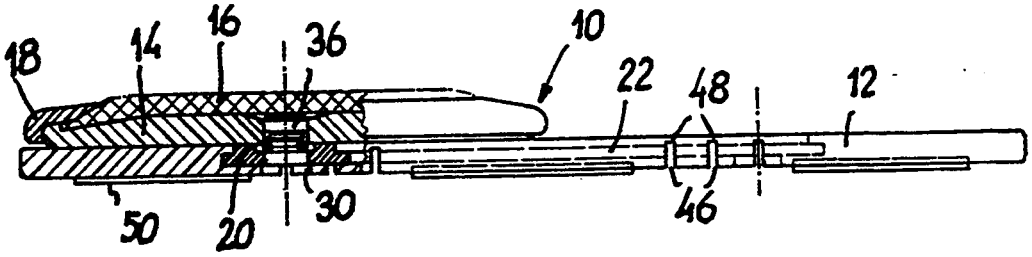
FIG. 1 a partially sectional longitudinal view of the rotary table.
Figure 2:
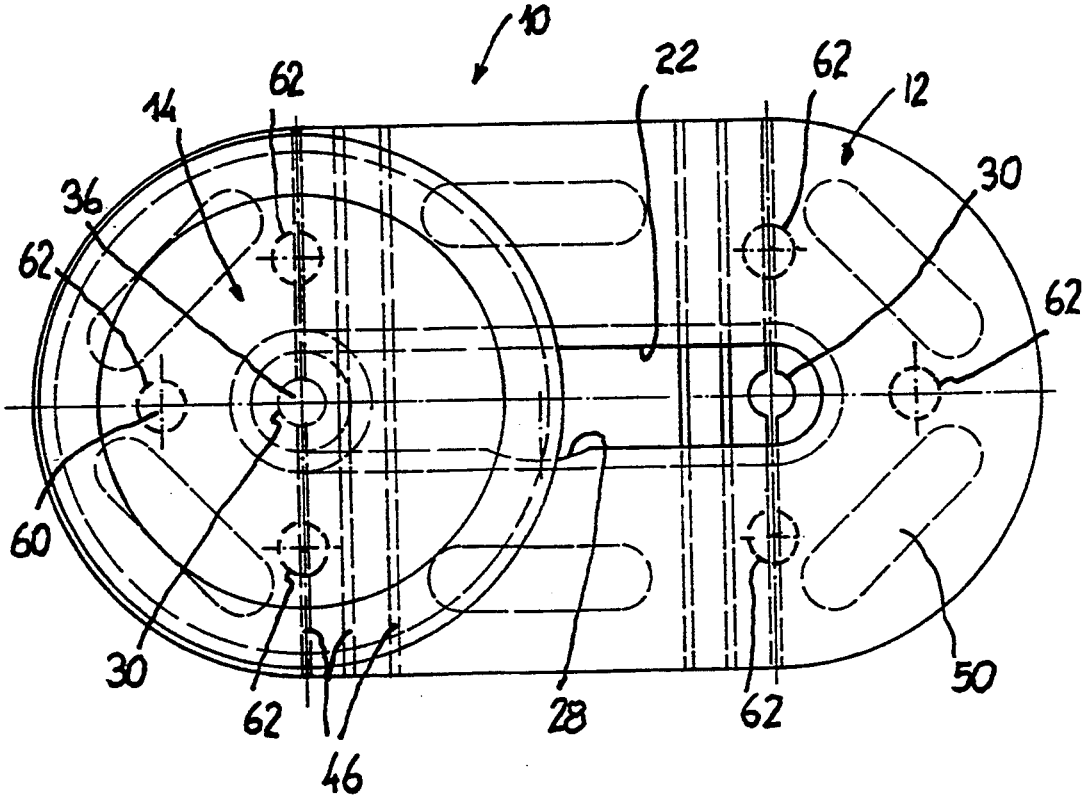
FIG. 2 a top view of the rotary table.
Figure 4:
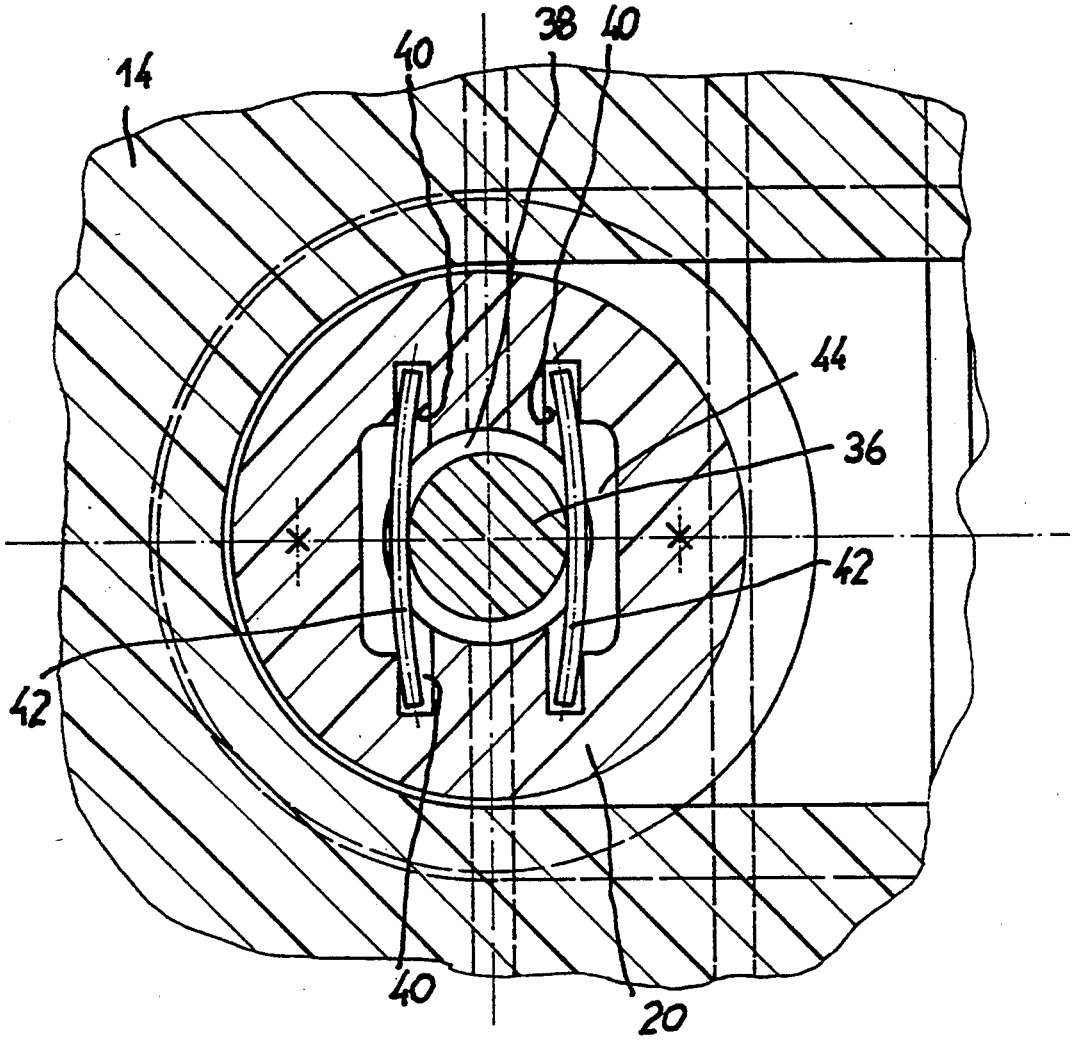

A rotary table 10 features a base plate 12, a rotary plate 14 with a cushioned mat 16 and holding means 18. A slide plate 20 is screwed onto the underside of the rotary plate 14. It is also in principle possible for the rotary plate 14 and the slide plate 20 to be manufactured as a single piece. The base plate 12 is of extended length and is contoured by two semicircle arcs joined by two straight lines. The diameter of the semicircle arcs is equal to that of the rotary plate 14 equipped with the holding means 18. The upper face of the base plate 12 contains an upwardly open track 22 consisting of a centrally located channel featuring a T-groove cross section. The circularly contoured slide plate can be rotated and displaced in this track 22. The upper face of the slide plate 20 has a diameter equal to the inside width of the track 22. The bottom half of the slide plate 20 features an external flange 24 which engages with a surrounding recess 26 in the base plate 12. The slide plate is fastened with screws 28 to the underside of the rotary plate 14. On one side of the upper wall in the middle of the track 22, there is a recess 28 (FIG. 2) which is designed to permit the insertion of the slide plate 20 into the track 22. Within the track 22, a hole 30 is provided at either end of the base plate 12. The holes 30 are situated in the plane of the longitudinal centre and are concentric with the semicircular contours of the base plate 12.

The rotary plate 14 and the slide plate 20 have mutually aligned continuous holes 32, 34 of the same diameter. These holes 32, 34 are arranged coaxially with the rotary plate's 14 axis of rotation. In the two slide end .positions of the rotary plate 14, the pair of holes 32, 34 are aligned with the respective holes 30, 30 in the base plate 12. The arrangement of holes 32, 34 contains a pin 36 which can be axially displaced. The middle part of the pin 36 features two axially separated circumferential grooves 38. Two pairs of opposing recesses 40 are provided in the upper side of the slide plate 20 to accommodate the ends of the spring wires 42. Each pair of recesses 40 is connected together by a recess 44 of the same depth as the recesses 40. The transverse distance between the two pairs of recesses 40, 40 is slightly smaller than the core diameter of the pin 36 at the annular grooves 38. The spring wires 42 engage under slight tension with one or other of the grooves 38.

The pin 36 is shown in FIG. 3 in its unlocked position. If a downward pressure is exerted on the mat 16 in the central area of the rotary plate 14, the spring wires 42 yield to this pressure by retreating into the recesses 44 owing to the V-shaped contour of the annular grooves 38. The pin can then descend until the spring wires 42 catch in the upper annular groove 38. The lower end of the pin 36 has then entered the hole 30 in the base plate 12 and the rotary plate 14 is secured against displacement in the respective end position of the base plate 12. Since the hole 30 is open at the bottom, the pin 36 can be lifted by finger pressure from below back into its unlocked position and caught in that position.

Each longitudinal half of the base plate 12 features a group of three parallel transverse grooves 46 which extend across the entire width of the base plate 12 and from beneath extend through almost the entire thickness of the base plate 12, the upper face of the base plate 12 being rendered continuous solely by a thin flexible web 48. At these flexible webs 48, the part of the base plate 12 not occupied by the rotary plate 14 can be bent up or down from the plane of the base plate. The downward bending distance is limited by the width of the transverse grooves 46. The free part of the base plate 12 can thus be bent down, for example, at 90° to the other part of the base plate.

Several anti-slip strips 50 are arranged on the underside of the base plate 12, preferably with a positive fit in suitable base recesses of the base plate 12.

Figure 5:
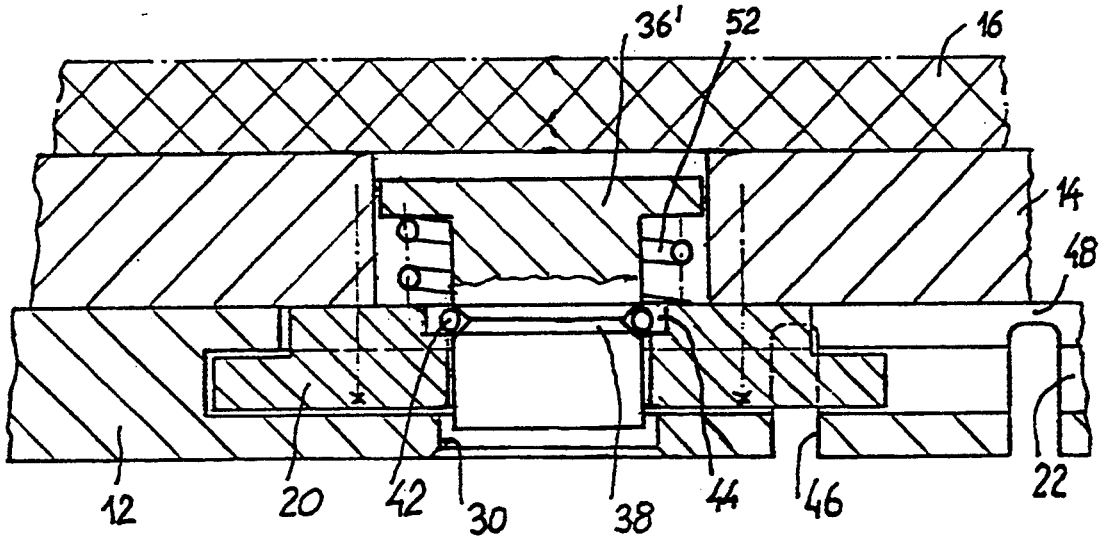

FIG. 5 shows a modification of the locking means for the rotary plate 14. Here the pin 36' has only one annular groove 38 for the pair of spring wires 42. The pin 36' has an upper external flange against which a compression spring 52 rests which is supported from beneath by the slide plate 20. FIG. 5 shows the pin 36' in its locked position in which it is inserted into the hole 30 of the base plate 12. If pressure is now exerted from above onto the cushioned mat 16 in the central area of the rotary plate 14, the entire pin 36' is pressed into the hole 30, the spring wires 42 being pressed outwards into the recesses 44. The compression spring 52 is thereby compressed. If the pin 36' is released, the pin 36' is displaced upwards due to the strong spring resistance. The spring wires 42 penetrate briefly into the annular groove 38 but are unable to brake the pin 36' owing to its dynamic force. The pin 36' thus overtravels this catch position and reaches its unlocked position on the underside of the cushioned mat 16.

The embodiment shown in FIG. 5 thus makes it possible to lock the rotary plate 14 from above through the exertion of controlled pressure onto the pin 36' and to effect its unlocking by exerting pressure in the same direction. This embodiment is thus chosen if a rotary table is to facilitate locking and unlocking with a person seated upon it.

FIG. 6 shows a further modification which accommodates an automatic locking and unlocking of the rotary plate 14. Here the pin 36'' no longer has an annular groove. Instead it is cup-shaped and a spring 54 holds down the pin 36'' in its locked position. Instead of a continuous hole 32, the rotary plate 14 features a blind hole 56 closed at the top enabling the top of the compression spring 54 to rest against the rotary plate 14. The hole 30 in the base plate 12 is directly adjoined in the base plate's 12 longitudinal axis by a rising angled ramp section 58 which terminates at the base face of the track 22. The width of this ramp face 58 is equal to the diameter of the hole 30. If a sliding force is exerted on the rotary plate 14 along the longitudinal axis, the pin 36'' slides after overcoming an initial resistance up onto the ramp face 58 and is lifted thereby from its locked into its unlocked position. This unlocked position is defined by the base face of the track 22 along which the pin 36'' slides. The bottom circumferential edge of the pin 36'' is preferably bevelled so that it can be relied upon to ride up onto the ramp 58.

In all of the above embodiments, the pin 36 is positioned in the centre of the rotary plate 14. The rotary plate 14 is thus secured against displacement in its two end positions or at least in one end position but rotatable in its locked position. If the pin 36 is relocated away from the centre of the plate, as illustrated at 60 with dotted lines in FIG. 2, and if the hole 30 is also relocated to this position, as illustrated at 62, the same principle can be employed to not only secure the rotary table against displacement but also and at the same time against rotation. If then two further transversely aligned holes 62 are provided on the same diameter as the hole 62 provided in the longitudinal plane in the base plate 12, each at respective angles of 90°, the rotary plate 14 can be locked in each of its slide end positions in three rotary positions at right-angles to each other.

I claim:

1. A seat for handicapped persons, said seat having a track on which a generally circular rotary plate is laterally displaceable between two end positions and is rotatably journalled in at least one of said end positions, a locking pin for securing said rotary plate against lateral displacement in at least one of said end positions characterized in that said track being formed as a thin base plate of extended length whose length measured along an axis of displacement of said track is at least twice as great as the diameter of said rotary plate, said track features a central longitudinal channel in which a ciruclarly contoured slide plate provided on the underside of said rotary plate is guided such that said rotary plate can be rotated and longitudinally displaced, said rotary plate and said slide plate each having a downwardly open aperture which are coaxially aligned, a base hole located in said channel at a longitudinal distance from the end of said longitudinal channel equal to the radius of said slide plate, said locking pin is capable of being axially displaced in the holes of the rotary plate and of the slide plate and engages with the base hole of the base plate at one of said at least one end positions to preclude lateral movement.

2. A seat as claimed in claim 1 characterized in that the hole in the rotary plate is upwardly open and the locking pin has two catch positions in which it is held by an arrangement of springs and that the two end faces of the pin form finger actuation faces.

3. A seat as claimed in claim 2 characterized in that the pin in an unlocked position is constantly upwardly loaded by an installed recuperating spring with axial action, that the pin after overtravelling a lower catch position in its downward motion and subsequently released is returned by the recuperating spring to its unlocked position.

4. A seat as claimed in claim 1 characterized in that the pin in a locked position is constantly loaded by an installed recuperating spring with axial action and, on displacement of the rotary plate, slides with its bottom end face along the bottom wall of the longitudinal channel and in the rotary plate's end position automatically engages with the base hole of the base plate.

5. A seat as claimed in claim 4 characterized in that an inclined lift ramp is formed adjoining the base hole in the base wall of the base plate along which the pin after overcoming an initial resistance is automatically lifted into an unlocked position on displacement of the rotary plate.

6. A seat as claimed in claim 1 characterized in that several holes are provided in the base plate at the same radial distance from a geometrical axis at distances along the circumference with which the pin can optionally engage and that the geometric axis intersects the center of the rotary plate in one of its two end positions.

7. A seat as claimed in claim 1 characterized in that the base plate forms a single-piece plastic part and that in the area between at least one longitudinal end of the base plate and the rotary plate displaced into the opposite end position there is at least one transverse groove extending across the entire width of of the base plate and, except for a thin flexible web, through the entire thickness of the base plate.

8. A seat as claimed in claim 7 characterized in that the flexible webs are situated on an upper face of the base plate.

9. A seat as claimed in claim 7 characterized in that in each longitudinal half of the longitudinal channel a group of transverse grooves extends at right-angles to the longitudinal extension of the base plate across an entire width of the base plate.

10. A seat as claimed in claim 1 characterized in that the base plate is symmetrical relative to its transverse center line.

* * * * *